US007268477B2

(12) United States Patent
Gueugnon et al.

(10) Patent No.: US 7,268,477 B2
(45) Date of Patent: Sep. 11, 2007

(54) CATHODE-RAY TUBE HAVING AN ELECTRON GUN WITH AN IMPROVED MAIN FOCUS LENS

(75) Inventors: Nicolas Gueugnon, Dijon (FR); Pierre Bizot, Marsanny la Cote (FR); Grégoire Gissot, Plombiere les Dijon (FR); Nicolas Richard, Dijon (FR)

(73) Assignee: Thomson Licensing, Boulogne-Billancourt (FR)

( * ) Notice: Subject to any disclaimer, the term of this patent is extended or adjusted under 35 U.S.C. 154(b) by 128 days.

(21) Appl. No.: 10/939,172

(22) Filed: Sep. 10, 2004

(65) Prior Publication Data

US 2006/0055306 A1 Mar. 16, 2006

(30) Foreign Application Priority Data

Sep. 10, 2003 (FR) ..... 03 50520

(51) Int. Cl.
*H01J 29/50* (2006.01)

(52) U.S. Cl. ..... 313/414; 313/409; 313/446; 313/453

(58) Field of Classification Search ..... 313/409, 313/414, 441, 446–449, 452–453
See application file for complete search history.

(56) References Cited

U.S. PATENT DOCUMENTS

| | | | | |
|---|---|---|---|---|
| 5,828,191 | A | 10/1998 | Shirai et al. | 315/382 |
| 6,133,684 | A * | 10/2000 | Kawaharada | 313/414 |
| 6,452,320 | B1 * | 9/2002 | New | 313/414 |
| 6,559,586 | B1 | 5/2003 | Alig et al. | 313/427 |
| 6,800,992 | B2 * | 10/2004 | Wada et al. | 313/414 |

OTHER PUBLICATIONS

Search Report.

* cited by examiner

*Primary Examiner*—Nimeshkumar D. Patel
*Assistant Examiner*—Kevin Quarterman
(74) *Attorney, Agent, or Firm*—Joseph J. Laks; Harvey D. Fried; Richard LaPeruta

(57) ABSTRACT

A cathode-ray tube has an electron gun with a main focusing lens, wherein each electrode comprises a rectangular aperture whose large dimension is along the horizontal axis (Ox) and terminating at its two ends in two identical semi-ellipses of order n that are symmetric with respect to the axis of the gun (Z).

5 Claims, 5 Drawing Sheets

CATHODE-RAY TUBE HAVING AN ELECTRON GUN WITH AN IMPROVED MAIN FOCUS LENS

FIELD OF THE INVENTION

The invention relates cathode-ray tubes (CRTs) and more particularly a electron gun with an improved main focus lens.

BACKGROUND OF THE INVENTION

A conventional television tube comprises an almost plane faceplate or screen of rectangular shape. The screen is furnished on its internal face with a mosaic of patches of phosphors or pixels which, excited by an electron beam, emit light which may be blue, green or red, depending on the phosphor excited.

An electron gun sealed in the envelope of the tube is directed towards the centre of the screen and makes it possible to emit the electron beam towards the various points of the screen through a perforated mask (or shadow mask). The electron gun makes it possible to focus the electron beams onto the internal face of the screen carrying the phosphors and to make them converge there.

A deviating system placed around or on either side of the tube makes it possible to act on the direction of the electron beam so as to deviate its trajectory. Continual action of the deviating system thus allows horizontal and vertical scanning of the screen so as to scan the entire mosaic of phosphors.

Without deviation of the electron beam and with symmetric electrodes of the gun that create symmetric electric fields in the gun, the electron beam reaches the centre of the screen.

FIGS. 1*a* and 1*b* represent an example of an electron gun to which the invention is applied.

This electron gun comprises a cathode K emitting electrons by thermoemission. An electrode G1 in cooperation with the electrode G2 initializes the formation of an electron beam along the axis Z from the electrons emitted by the cathode.

The electrode G2 focuses the beam thus constituted to a focusing point, called the "crossover". The size of this focusing point is as point-like as possible. By way of example, the electrode G1 is at a static potential lying between earth and 100 volts. The electrode G2 is at a potential lying between 300 volts and 1200 volts.

The electrode G3 raised, according to this example, to a potential of between 6000 and 9000 volts helps to accelerate the electrons.

The electrode G4 raised to a potential substantially equivalent to that of the electrode G2 constitutes with the electrode G3 and the part of the electrode G5 facing G4 a prefocusing electron lens for the electron beam as is represented in FIG. 1*b*.

The electrodes G5, G6 and G7 constitute quadrupolar lenses and will induce a quadrupolar effect on the beam in such a way as to exert a compressive load on the electron beam in the vertical plane and a distortion in the horizontal plane. As described previously, the deformations of the beam are bigger at the periphery of the screen and in particular at the corners of the screen. They increase continuously from the centre of the screen to the periphery. The set of electrodes or quadrupole G5, G6, G7 must therefore carry out a precorrection as a function of the deviation of the beam. This correction must be carried out continuously in synchronism with the screen scanning system. The makeup of the quadrupole created by G5, G6, G7 and the control of the electrodes will be described later.

The device G7-G8 achieves a quadrupolar effect which tends to exert on the electron beam a compressive load in the horizontal plane and a distortion in the vertical plane as was described in relation.

The electrode G9 is the electrode which together with G8 constitutes the principal exit lens.

In a three-colour tube of "in-line" type, the electron gun makes it possible to handle three electron beams (red, green and blue) disposed in one and the same plane. For this purpose, the electron gun possesses electrodes furnished with three holes disposed in line for handling three electron beams.

The invention relates to the main focusing lens of an electron gun of "in-line" type used in three-colour cathode-ray tubes (CRT).

An electron gun is characterized by the following properties:

- focus voltage Vf (FIG. 5) and anode voltage (FIG. 5) making it possible respectively to focus and to accelerate the electron beams to the screen. In the case of a Dynamic Focus Modulation gun (DFM gun), the focusing voltage is dynamic and called Vd (FIG. 5),
- a "bias" which is defined as being the difference between Vd and Vf (bias=Vd−Vf) at the centre of the screen.
- a "delta focus" which is defined as being the difference between the focusing voltage (Vdext) allowing the outer electron beams (red and blue beams for example) to focus at a point on the screen (at the centre for example) and the focusing voltage (Vdint) allowing the central beam (green beam for example) to focus at the same point. As a general rule, it is essential for the "delta focus=Vdext−Vdint" to be zero.
- the convergence of the three electron beams (red, green and blue) at the centre of the screen is defined as the manner of impact on the screen of the outer beams (red and blue beams for example) with respect to the central beam on the screen (green beam for example).

Generally, the "delta focus" is corrected by modifying the diameters of horizontal holes (φH1, φHint=2Rhint and φHext=2RHext in FIG. 3*a*). In certain configurations, it is not possible to correct the entire delta focus by modifying these diameters through the use of hardware. It has therefore been necessary to find a new parameter for adjusting the "delta focus".

The invention makes it possible to adjust the "delta focus" by modifying the shape of the edges of the electrodes of the main focusing lens.

SUMMARY OF THE INVENTION

The invention therefore relates to a main focusing lens for a three-colour cathode-ray tube electron gun comprising a focusing electrode and an acceleration electrode aligned along the mean axis of emission of the electron gun. Each electrode comprises an aperture of elongate form along a horizontal axis and a plate furnished with a central hole and with outer holes, disposed in proximity to the aperture of the electrode and parallel to this aperture. The three holes of each plate are aligned along an axis parallel to the horizontal axis. The aperture of each electrode comprises a rectangular aperture whose large dimension is along the horizontal axis and terminating at its two ends in two identical semi-ellipses of order n that are symmetric with respect to the axis of the gun, and of formula:

$$\left(\frac{x}{a}\right)^{\frac{2}{n}}+\left(\frac{y}{b}\right)^{\frac{2}{n}}=1$$

in which x=a cos$^n$ θ; y=b sin$^n$ θ, the parameter n has a value different from 1, a is half the width of the ellipses of order n along the horizontal axis (Ox) and b being half the height of the ellipses of order n along the vertical axis (Oy) (FIG. 3*a*), x represents the abscissa of a point lying on the ellipse of order n and y is the ordinate of a point lying on the ellipse of order n, θ is an angle which varies in one quadrant between 0° and 90°.

Preferably, the parameter n has a value such that 0<n<2. And in particular the value of n may lie between around 0.5 and around 1.5.

According to one embodiment of the invention, the parameter n is given by the formula $$n=A11\times(\text{DeltaFocus})^2+A1\times\text{DeltaFocus}+A0$$

in which the values of the coefficients A11, A1 and A0 are approximately as follows:

A11=−3.576 $10^{-6}$

A1=2.867 $10^{-3}$

A0=0.987

Preferably, the outer holes of the electrodes are of elliptical shape and have an outer diameter that can vary by a value δφVext of between −1 mm and 1 mm from an outer diameter φVext which makes it possible to obtain correct focusing of the electron beams onto the screen in a configuration where the parameter n of the ellipses of order n has the value 1.

This variation δφVext of the vertical diameter of the outer holes can be given by the formula $$\delta\phi Vext=B11\times n^2+B1\times n+B0$$

in which the values of the coefficients B11, B1 and B0 are as follows:

B11=0.362

B1=4.44 $10^{-2}$

B0=−0.407.

BRIEF DESCRIPTION OF THE DRAWINGS

The various aspects and characteristics of the invention will become more clearly apparent in the description which follows and in the appended figures which represent.

DETAILED DESCRIPTION OF THE PREFERRED EMBODIMENT

The invention therefore relates to a main focusing lens system making it possible to adjust the "delta focus", that is to say the difference between the focusing voltage for the outer beams (red and blue beams) and that associated with the central beam (green beam) by modifying the electrodes possessing shapes in the form of "ellipses of order n" also referred to as "super ellipses" and more precisely by modifying the coefficient of the "super ellipse" on the edges 11' and 12' of the electrodes. The invention relates to Dynamic Focus Modulation guns (DFM guns) and non-DFM guns (regardless of the position Vf=Vd).

Generally, an "ellipse of order n" or "super ellipse" is described by a relation of the following type:

$$\left(\frac{x}{a}\right)^{\frac{2}{n}}+\left(\frac{y}{b}\right)^{\frac{2}{n}}=1$$

where x=a cos$^n$ θ; y=b sin$^n$ θ where:

a and b respectively define half the width of the "super ellipse" along the horizontal axis (Ox in FIG. 3*b*) and half the height of the "super ellipse" along the vertical axis (Oy in FIG. 3*b*), x represents the abscissa of a point lying on the "super ellipse" and y is the ordinate of a point lying on the "super ellipse", θ is an angle which varies in one quadrant between 0° and 90°, and the exponent n determines the coefficient of ellipticity, that is to say if n tends to 0 one obtains a rectangle, if n=1 one obtains an ellipse and if n=2 one obtains a diamond. Examples of "super ellipse" shapes adapted to the present invention for parameters of n=0.5 and 1.5 are represented respectively in FIGS. 4*a* and 4*b*.

Figure 1A:
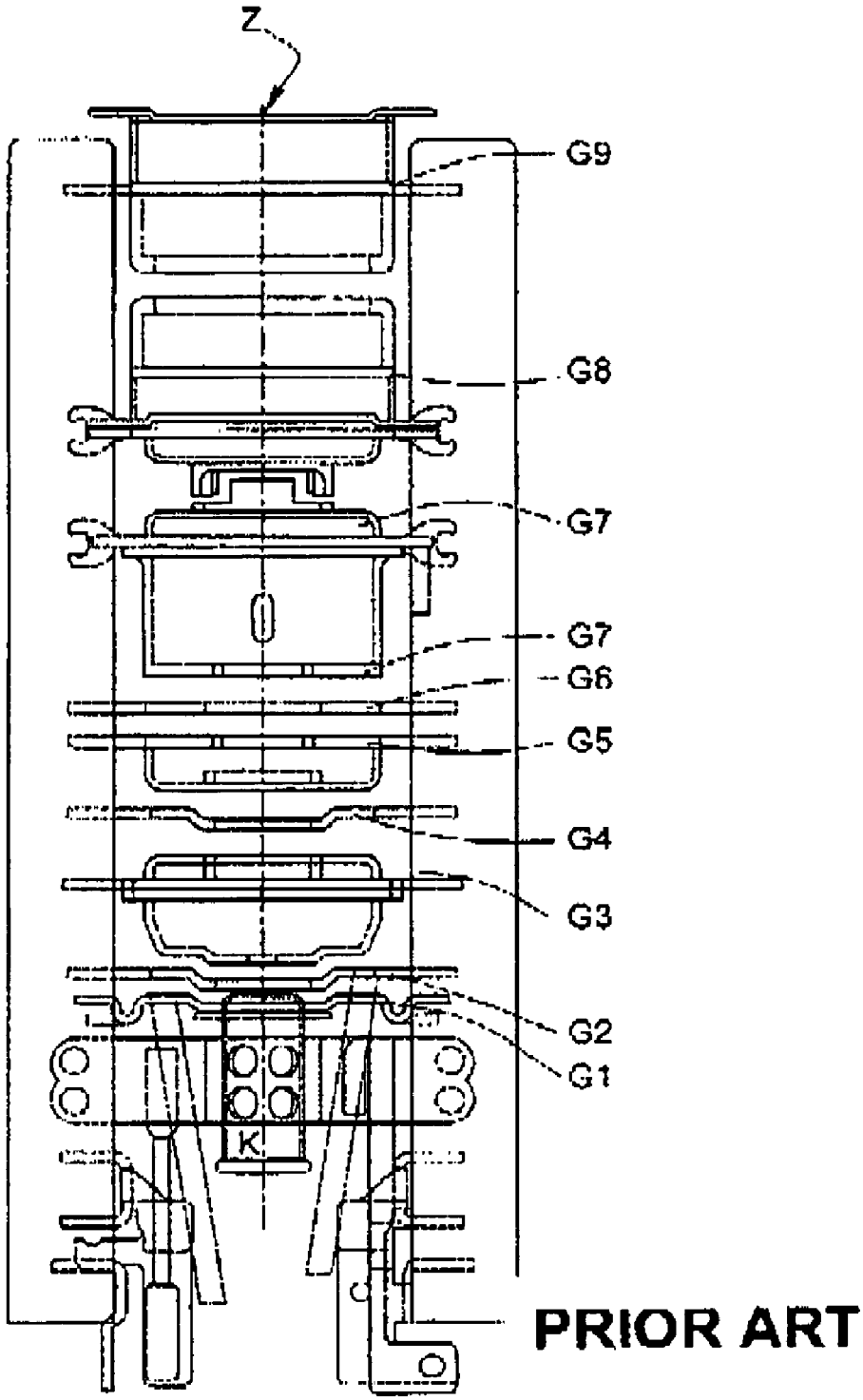
FIGS. 1*a* and 1*b*, an exemplary electron gun to which the invention is applied, FIG. 2, an exemplary main focusing lens of an electron gun to which the invention is applied, FIGS. 3*a* and 3*b*, an exemplary embodiment of a main focusing lens of an electron gun according to the invention, FIGS. 4*a* and 4*b*, two examples of shapes of electrodes of a main focusing lens according to the invention, FIG. 5, control voltages for the electron gun, and FIG. 6, curves according to the invention for determining the shape of the electrodes of a main focusing lens.
Figure 1B:
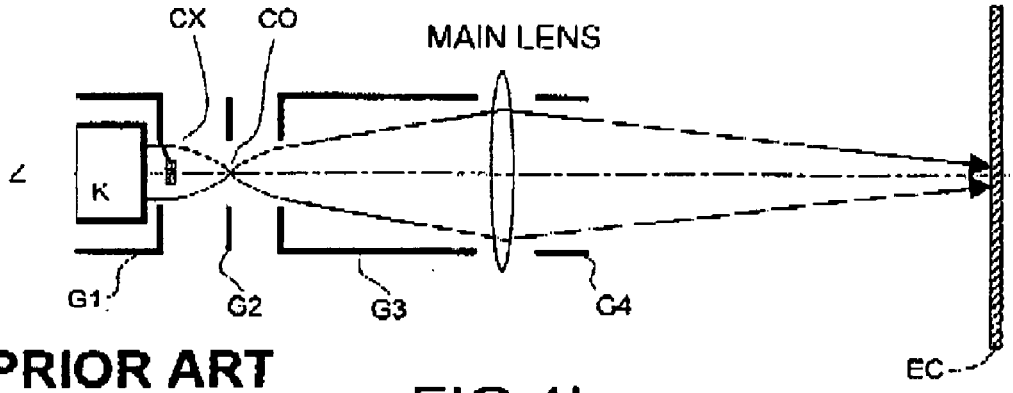
PRIOR ART FIG.1b
Figure 2:
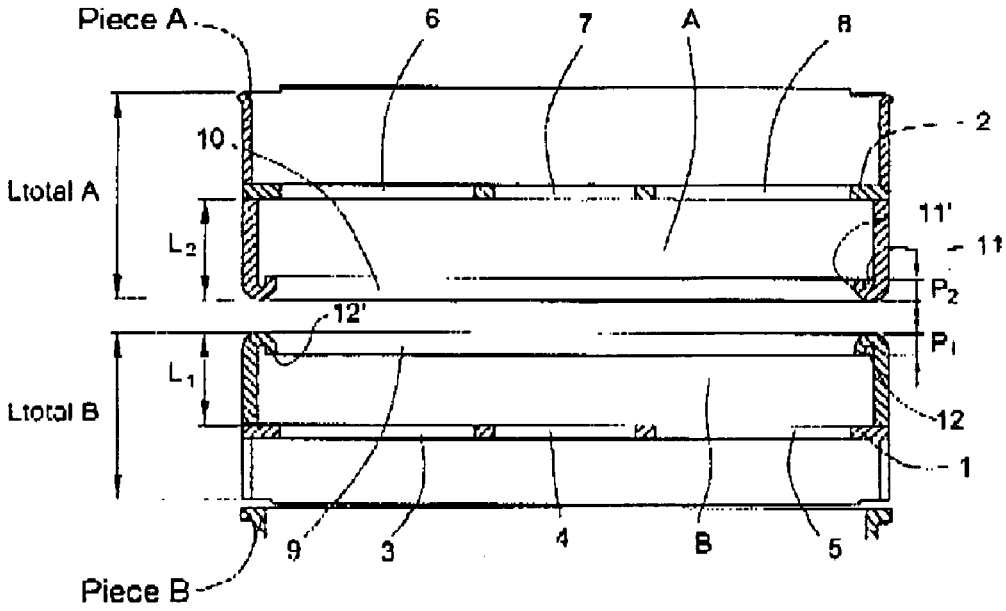
Figure 3A:
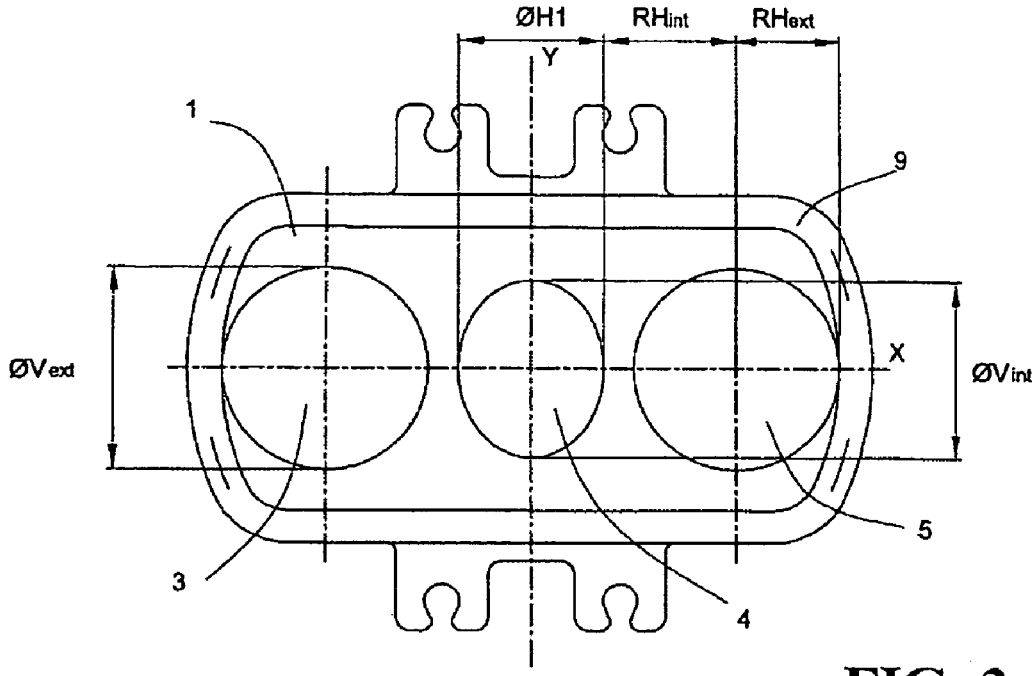
Figure 3B:
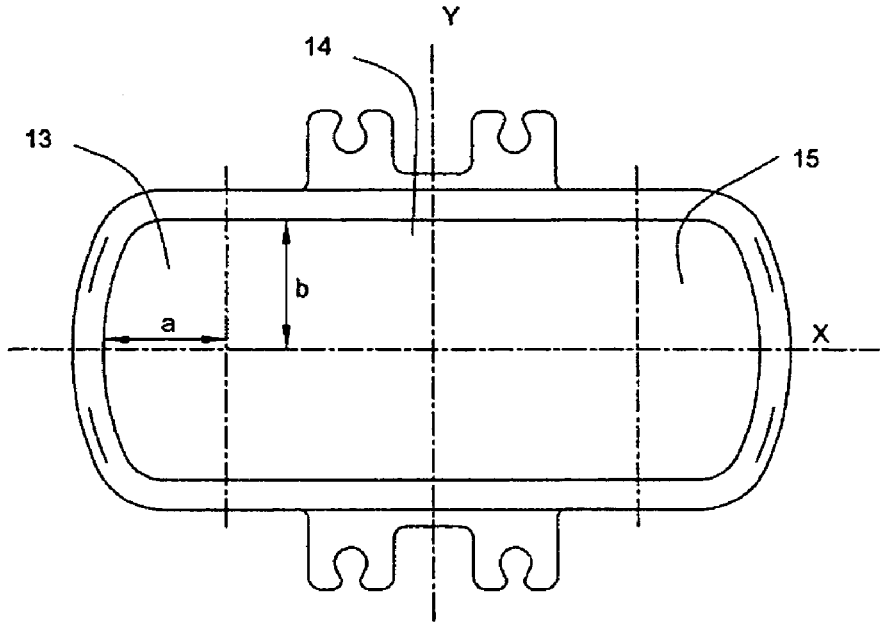
Figure 4A:
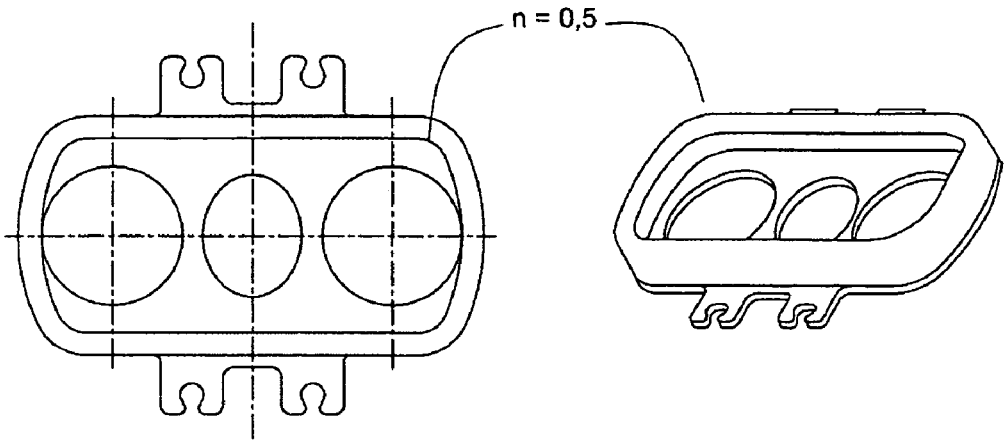
Figure 4B:
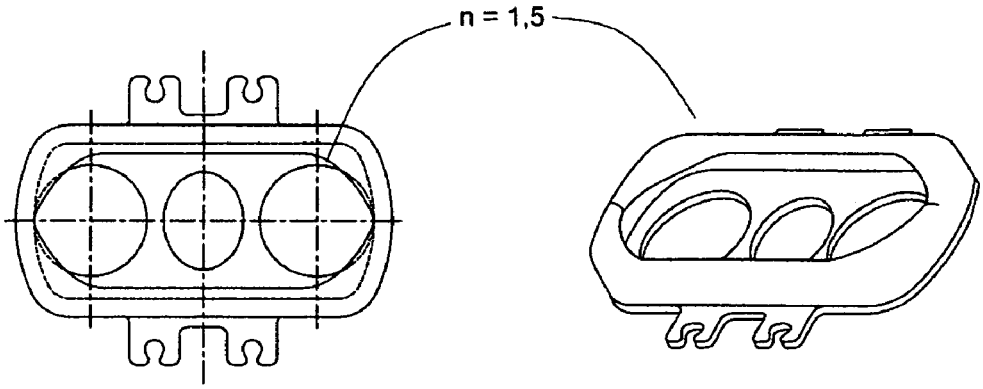
Figure 5:
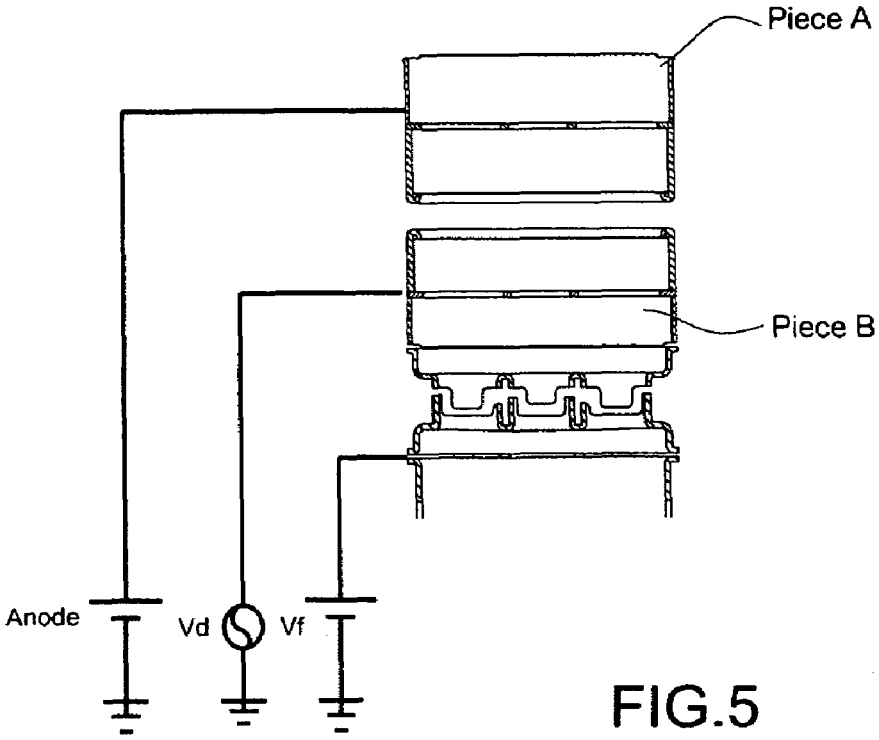

As represented in FIG. 2, a main focusing lens comprises an acceleration electrode A and a focusing electrode B. Each electrode comprises an aperture 9 for the electrode B and 10 for the electrode A. As represented in FIG. 3*b*, each aperture 9 and 10 comprises a rectangular aperture 14 extended by two semi "ellipses of order n" 13 and 15 of radius a and b and with parameter n. Each electrode A and B respectively has depth L2 and L1 opposite one another.

Moreover, the two apertures 9 and 10 are greatly elongated in the horizontal direction. They are composed of two identical material foldbacks 11 and 12 of depth P1 and P2.

They furthermore comprise two plates 1 and 2 each drilled with three holes 3, 4, 5, 6, 7 and 8 in line in the horizontal direction. These plates are positioned at distances L1 and L2 from the edge of the two apertures 9 and 10. The distances L1 and L2 are adjusted in such a way as to keep the two lengths LtotalA and LtotalB constant.

The central holes 4 and 7 are of elliptical shapes and of identical dimensions. The outer holes 3, 5, 6 and 8 are of elliptical shapes comprising (see FIG. 3*a*) an inner horizontal diameter ΦHint=2RHint, an outer horizontal diameter φHext=2RHext and a vertical diameter ΦVext. These outer holes 3, 5, 6 and 8 are symmetric with respect to the central holes 4 and 7 and of identical dimensions. The piece B is connected to a dynamic voltage Vd and the piece A is connected to a voltage allowing the final acceleration of the electrons (anode).

The invention makes it possible to cancel the "delta focus" by modifying, for each electrode A and B, the parameter n of the equations of the "super ellipses" of the ends of the apertures 9 and 10 of the electrodes.

This parameter n is given by the following polynomial:

$$n=A11\times(\text{DeltaFocus})^2+A1\times\text{DeltaFocus}+A0$$

Preferably, the values of the coefficients A11, A1 and A0 may be as follows:

A11=−3.576 $10^{-6}$

A1=2.867 $10^{-2}$

A0=0.987

Consequently, to retain the operating point, it is necessary, starting from a configuration where n=1 and in which the focusing of the electron beams is done correctly onto the screen, to readjust the diameters ϕVext of the outer holes 3, 5, 6, 8 of the electrodes. For this purpose, the necessary modification of the vertical diameters ϕVext of the outer holes is calculated on the basis of the new coefficient n obtained previously, with the aid of the following formula:

$$\delta\phi Vext=B11\times n^2+B1\times n+B0$$

The values of the coefficients B11, B1 and B0 may preferably be the following:

B11=0.362

B1=4.44 $10^{-2}$

B0=−0.407

In these formulae, n is the parameter of the identical semi "super ellipses" facing one another in each electrode.

"DeltaFocus" is the difference in voltages that one wishes to correct as explained previously.

δϕVext is the variation in the vertical size of the outer holes making it possible to readjust the focusing of the outer beams.

These relations have a good correlation coefficient ($R^2$=0.99).

According to the invention, n and δϕVext preferably have values lying in the following ranges of values:

0<n<2 with n different from 1. In particular, it will be possible to choose a value of between around 0.5 and around 1.5.

−1 mm<δϕVext<1 mm regardless of the value of ϕVext this being so for the following variations of DeltaFocus:

−300 V<DeltaFocus<300V.

Figure 6:
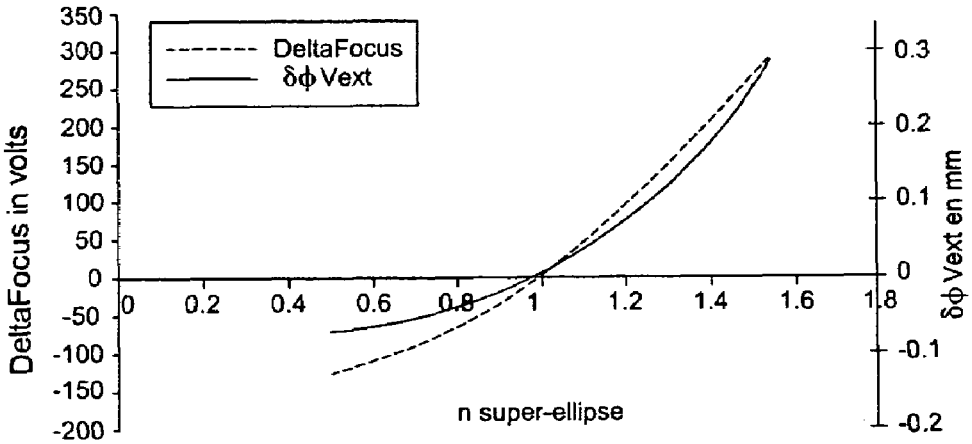

FIG. 6 represents curves for determining the parameter n of the super ellipses and the variation in the vertical diameter δϕVext of the outer holes of the electrodes. Plotted as abscissa are various values of the parameter n, plotted as ordinate on the left are various values of DeltaFocus and plotted as ordinate on the right are various values of variations δϕVext. The curves "Deltafocus" and "δϕVext" have been produced by a specified electron gun. The zero ordinate reference corresponds to a gun for which the parameters n of the super ellipses of the electrodes is equal to 1. To obtain a specified DeltaFocus that one wishes to produce, the "Deltafocus" curve makes it possible to obtain the value of the parameter n of the "super ellipses" of the electrodes and subsequently the value of the modification δϕVext to be applied to the outer holes of the electrodes.

What is claimed is:

1. A cathode-ray tube having an electron gun having a main focusing lens, the electron gun comprising a focusing electrode and an acceleration electrode aligned along the mean axis of emission of the electron gun, each electrode comprising:

a plate furnished with a central hole and two outer holes, the three holes of each plate being aligned along an axis parallel to the horizontal axis; and, a portion having an inner edge that defines a single aperture elongated along the horizontal axis through which all electron beam pass; wherein the three holes are diaposed in proximity to the single aperture and are parallel to the single aperture, and the single aperture comprises a rectangular central portion whose larger dimension is along the horizontal axis and end portions terminating in two identical semi-ellipses of order n that are symmetric with respect to the axis of the gun, and of formula:

$$\left(\frac{x}{a}\right)^{\frac{2}{n}}+\left(\frac{y}{b}\right)^{\frac{2}{n}}=1$$

in which x=a $\cos^n\theta$; y=b $\sin^n\theta$, the parameter n has a value different from 1, a is half the width of the ellipses of order n along the horizontal axis and b being half the height of the ellipses of order n along the vertical axis, x represents the abscissa of a point lying on the ellipse of order n and y is the ordinate of a point lying on the ellipses of order n, θ is an angle which varies in one quadrant between 0° and 90°.

2. The cathode-ray tube according to claim 1, wherein the parameter n has a value such that 0<n<2.

3. The cathode-ray tube according to claim 2, wherein the parameter n is given by the formula $$n=A11\times(\text{DeltaFocus})^2+A1\times\text{DeltaFocus}+A0$$

in which.

A11=−3.576 $10^{-6}$;

A1=2.867 $10^{-3}$;

A0=0.987; and,

"delta focus" is difference between the focusing voltage of the outer beams and that associated with the central beam.

4. The cathode-ray tube according to claim 1, wherein the outer holes are of elliptical shape and have an outer diameter that can vary by a value δϕVext of between −1 mm and 1 mm from an outer diameter 100 Vext which makes it possible to obtain correct focusing of the electron beams onto the screen in a configuration where the parameter n of the ellipses of order n has the value 1.

5. The cathode-ray tube according to claim 4, characterized in that the variation δϕ Vext of the vertical diameter of the outer holes is given by the formula $$\delta\phi Vext=B11\times n^2+B1\times n+B0$$

in which the values of the coefficients B11, B1 and B0 are as follows:

B11=0.362;

B1=4.44 $10^{31\ 2}$; and,

B0=−0.407.

* * * * *